US006273031B1

(12) United States Patent
Verdegan et al.

(10) Patent No.: US 6,273,031 B1
(45) Date of Patent: Aug. 14, 2001

(54) CLEAN LUBRICANT CIRCULATION SYSTEM

(75) Inventors: Barry M. Verdegan, Stoughton, WI (US); Peter K. Herman; David M. Stehouwer, both of Cookeville, TN (US); Brian W. Schwandt, Fort Atkinson; Stephen L. Fallon, Madison, both of WI (US)

(73) Assignee: Nelson Industries, Inc., Stoughton, WI (US)

( * ) Notice: Subject to any disclaimer, the term of this patent is extended or adjusted under 35 U.S.C. 154(b) by 0 days.

(21) Appl. No.: 09/210,363

(22) Filed: Dec. 11, 1998

(51) Int. Cl.[7] ..... F02B 75/00; F01M 1/10

(52) U.S. Cl. ..... 123/1 A; 123/196 A

(58) Field of Search ..... 123/1 A, 196 R, 123/196 A, 196 M; 184/6.24, 1.5

(56) References Cited

U.S. PATENT DOCUMENTS

| | | | | |
|---|---|---|---|---|
| 3,154,485 | | 10/1964 | Liddell . | |
| 3,425,558 | | 2/1969 | Rosaen . | |
| 3,432,005 | | 3/1969 | Gates . | |
| 4,256,583 | | 3/1981 | Lennartz . | |
| 4,421,078 | | 12/1983 | Hurner . | |
| 4,495,909 | | 1/1985 | Hurner . | |
| 4,636,306 | | 1/1987 | Radmall . | |
| 4,766,860 | * | 8/1988 | Abe et al. | 123/196 A |
| 4,923,068 | | 5/1990 | Crowson . | |
| 4,951,784 | | 8/1990 | Bedi . | |
| 5,024,763 | | 6/1991 | Schlaginhaufen . | |
| 5,062,398 | | 11/1991 | Bedi et al. . | |
| 5,145,033 | * | 9/1992 | Bedi et al. | 184/1.5 |
| 5,223,155 | | 6/1993 | Ginn et al. . | |
| 5,249,608 | | 10/1993 | Hua . | |
| 5,353,760 | * | 10/1994 | Zager | 123/196 S |
| 5,390,762 | * | 2/1995 | Nelson | 184/1.5 |
| 5,462,679 | | 10/1995 | Verdegan et al. . | |
| 5,476,073 | * | 12/1995 | Betts | 123/73 AD |
| 5,562,181 | | 10/1996 | Elkin et al. . | |
| 5,565,094 | | 10/1996 | Zoch et al. . | |
| 5,566,781 | * | 10/1996 | Robert et al. | 184/1.5 |
| 5,592,395 | * | 1/1997 | Braun et al. | 702/50 |
| 5,674,392 | | 10/1997 | Christophe et al. . | |
| 5,676,842 | | 10/1997 | Bedi et al. . | |
| 5,685,396 | * | 11/1997 | Elkin et al. | 184/1.5 |
| 5,720,249 | * | 2/1998 | Betts et al. | 123/196 S |
| 5,749,339 | | 5/1998 | Graham et al. . | |
| 5,779,900 | | 7/1998 | Holm et al. . | |
| 5,816,212 | * | 10/1998 | Lindquist et al. | 123/196 R |
| 5,957,240 | * | 9/1999 | Apostolides | 184/1.5 |
| 5,964,318 | * | 10/1999 | Boyle et al. | 184/1.5 |

OTHER PUBLICATIONS

"Centinel, Advanced Engine Oil Management System", Cummins Engine Co. Bulletin 3698966, Feb. 1997.

"Spinner II CS Cleanable Screen", Glacier Metal Co., T.F. Hudgins, Bulletin 71804/15M, Nov. 1996.

"Eliminate Lube Oil Filter Disposal With Alfa Laval's Eliminator", Sep. 1997.

"Cummins Eliminator Oil Filter™", Bulletin 82297220, Sep. 22, 1997.

* cited by examiner

*Primary Examiner*—Noah P. Kamen
*Assistant Examiner*—Hai Huynh
(74) *Attorney, Agent, or Firm*—Andrus, Sceales, Starke & Sawall, LLP

(57) ABSTRACT

A combination in situ oil filter purge and oil replacement system is provided in a lubrication system, including for an internal combustion engine (10). A purge system back-flushes the oil filter (12) and re-circulates backflushed used oil. A replacement system supplies fresh oil to the filter (12).

52 Claims, 6 Drawing Sheets

CLEAN LUBRICANT CIRCULATION SYSTEM

BACKGROUND AND SUMMARY OF THE INVENTION

The invention relates to lubricant circulation systems, including for internal combustion engines, and more particularly to purge systems, replenishment systems, and combinations thereof.

The invention arose during continuing development efforts relating to the subject matter of commonly owned copending U.S. application Ser. No. 09/013,531, filed Jan. 26, 1998, U.S. Ser. No. 08/819,296, filed Mar. 18, 1997, U.S. Ser. No. 08/755,479, filed Nov. 22, 1996, and U.S. Pat. Nos. 5,779,900, 5,749,339, 5,462,679, all incorporated herein by reference. The '339 patent provides extended service intervals by providing continuous oil replacement and disposal. Periodic filter replacement and disposal is also provided. The oil replacement system tracks the engine's duty cycle.

In lubrication systems having a circulation system circulating lubricant to a machine, such as an internal combustion engine, customers and users are demanding increased competitive advantages, including reduced life-cycle costs, extended service intervals, reduced down time, reduced cost of replacement parts, reduced disposal costs, quicker service and cleaner service. Prior systems addressing such needs provide advantages enabling self-cleaning full-flow, and infrequent service, e.g. 10,000 hours, but suffer disadvantages including high initial cost, a centrifuge that requires cleaning every 1,000 to 2,000 hours, large and heavy structural components, and no oil replenishment. Other systems offer advantages including a permanent filter with no replacement parts needed, retrofit to current engine full-flow heads, and reasonable initial cost, but suffer disadvantages including no reduction of the service interval requirement, i.e., the filter and the centrifuge need cleaning, low efficiency wire mesh full-flow, and no oil replenishment.

The present invention addresses and solves the above noted needs, without the noted disadvantages.

DETAILED DESCRIPTION OF THE PREFERRED EMBODIMENT

Figure 1:
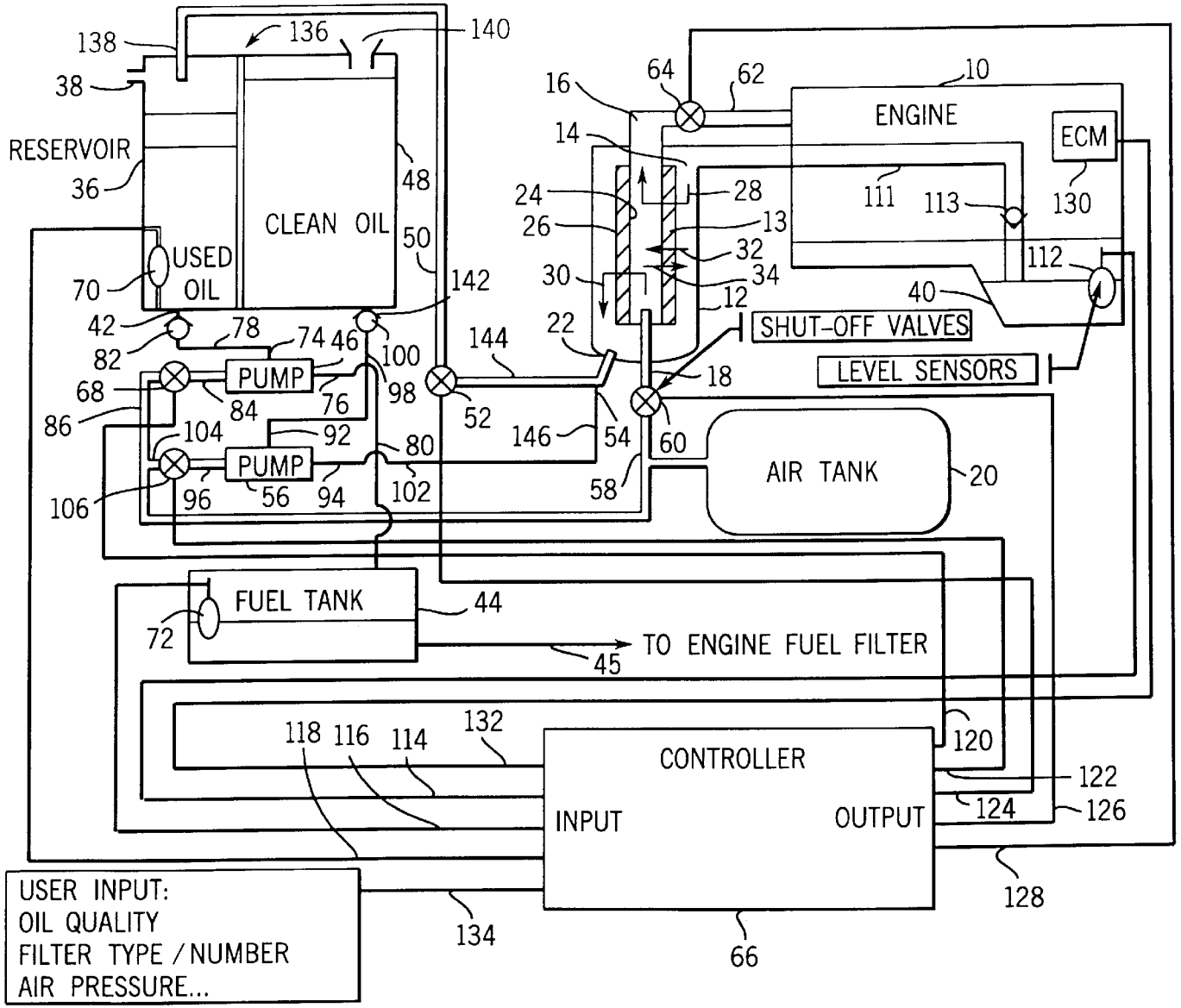
FIG. 1 is a schematic illustration of a lubrication system in accordance with the invention.

FIG. 1 shows a lubrication system including a circulation system circulating lubricant, such as oil, to a machine 10, such as an internal combustion engine. A filter 12 in the circulation system includes a filter media element 13 filtering the oil. Filter 12 is like that shown in incorporated U.S. Pat. Nos. 5,462,679 and 5,779,900, and will be only briefly described. Filter 12 has a first inlet 14 receiving oil from engine 10, a first outlet 16 returning oil back to engine 10, a second inlet 18 receiving a cleaning fluid from a source 20 of cleaning fluid, such as compressed air from a compressed air tank, as in the noted incorporated patents, and a second outlet 22 exhausting the cleaning fluid and used oil. Filter media element 13 has a clean side 24 communicating with outlet 16 and inlet 18, and has a dirty side 26 communicating with inlet 14 and outlet 22. Filter 12 is a cylindrical canister member having annular filter media element 13 therein. Incoming oil at 14 from the engine flows into the annular space between element 13 and the outer wall of cylindrical filter canister 12, and then flows radially inwardly through filter media element 13 into the hollow interior thereof, and then exits axially upwardly to outlet 16 and returns to the engine, all as is standard and known in the prior art. The filter has a first flowpath 28 therethrough from inlet 14 through filter media element 13 in one direction to outlet 16. The filter has a second flowpath 30 therethrough from inlet 18 through filter media element 13 in the opposite direction to outlet 22. Flowpaths 28 and 30 have common but opposite direction portions 32, 34, respectively, through filter media element 13. The system described thus far is known in the prior art, for example as shown in the above incorporated patents.

A used-oil tank 36 is connected to filter outlet 22 for storing used oil. Tank 36 has a vent port 38 for exhausting the cleaning fluid, which is particularly desirable when the cleaning fluid is air. Vent port 38 may include a filter for filtering used oil entrained in the air exhausting from tank 36. Tank 36 is separate from the oil sump 40 of the engine. Tank 36 has a discharge port 42 discharging used oil to the fuel tank 44 of the engine for combustion by the engine. Used oil is supplied from discharge port 42 through a metering pump 46 to fuel tank 44. Metering pump 46 is preferably an air-driven piston pump because of its ready availability, and is driven by the source of compressed air 20, to be described. In an alternate embodiment, used oil from filter 12 at outlet 22 is supplied to the fuel system, without a used-oil tank 36, for example by supplying the used oil to fuel tank 44, or to a fuel line, such as fuel line 45 to the engine or a return or recirculating fuel line.

The system includes a fresh-oil tank 48 supplying fresh oil to filter 12. Fresh-oil tank 48 supplies fresh oil to the dirty side 26 of filter media element 13. In an alternate embodiment, FIG. 6, to be described, fresh oil is supplied to the clean side 24 of filter media element 13. In FIG. 1, the fresh oil is supplied to filter outlet 22. A conduit 50 extends from outlet 22, and a shut-off valve 52 is provided in conduit 50. Fresh oil is supplied from fresh-oil tank 48 to conduit 50 at a location 54 between outlet 22 and valve 52. The fresh oil is supplied from fresh-oil tank 48 through a metering pump 56 to filter 12. Metering pump 56 is preferably an air-driven piston pump because of its ready availability, and is driven by the source of compressed air 20, to be described. In an alternate embodiment, the fresh-oil tank is eliminated, and instead the operator tops off oil sump 40 as needed, to supply fresh oil to the system.

Figure 2:
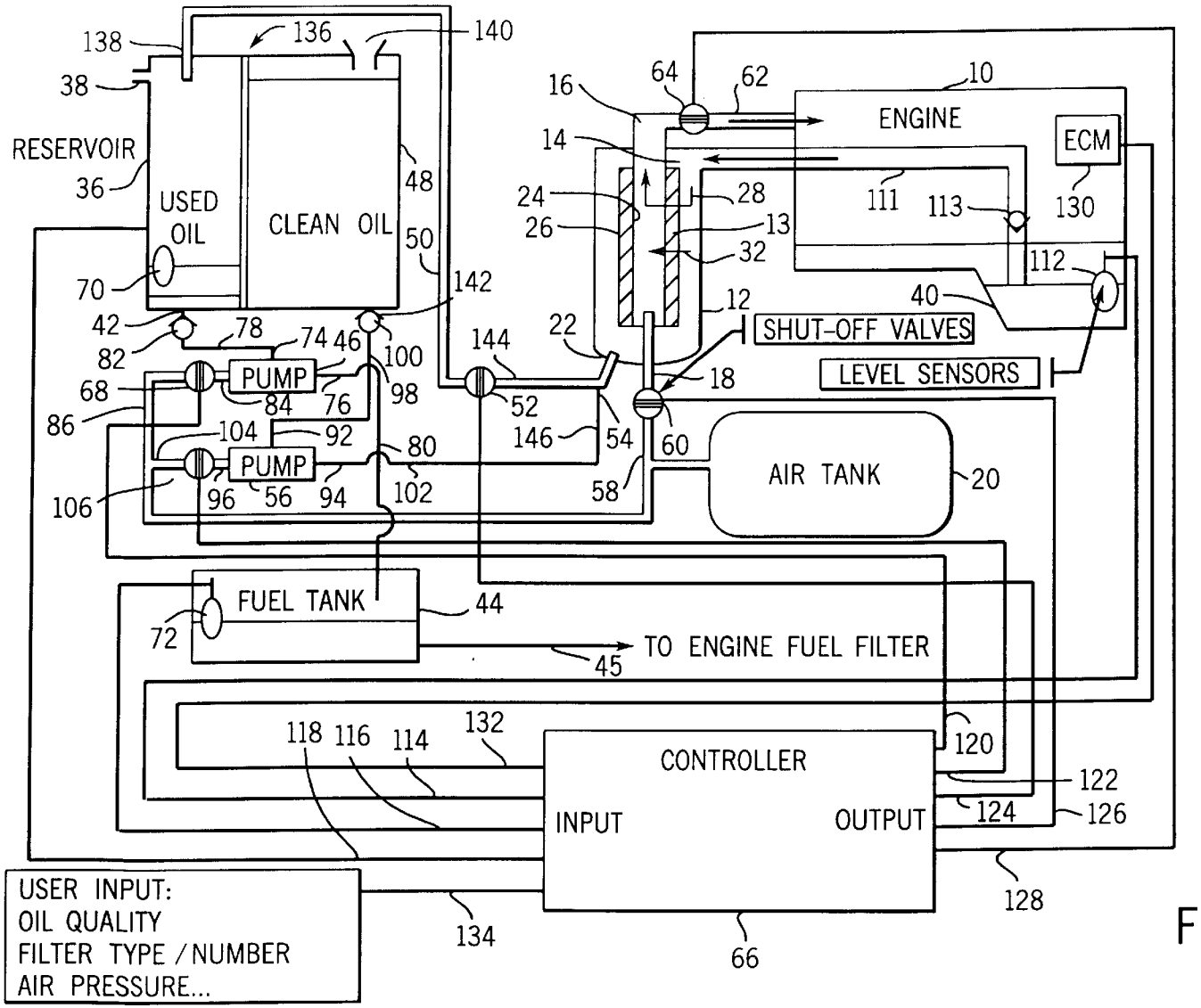
FIG. 2 is like FIG. 1 and shows an operational mode.

Used-oil tank 36 stores used oil therein. A conduit 58 is connected between the source of cleaning fluid at compressed air tank 20 and filter inlet 18. A shut-off valve 60 is provided in conduit 58. A conduit 62 is connected between filter outlet 16 and engine 10. A shut-off valve 64 is provided in conduit 62. A central controller 66 has a normal operation state, FIG. 2, closing valves 52 and 60 and opening valve 64. Controller 66 has a backflush cycle state, FIG. 3, closing valve 64 and opening valves 52 and 60. Metering pump 46 controls the supply of used oil from discharge port 42 of used-oil tank 36 to fuel tank 44. Metering pump 46 is controlled by shut-off valve 68. A level sensor 70 is provided in used-oil tank 36, and a level sensor 72 is provided in fuel tank 44. Controller 66 responds to level sensors 70 and 72 for actuating shut-off valve 68 and metering pump 46. Metering pump 46 has an inlet port 74 and an outlet port 76.

Conduit 78 is connected between discharge port 42 of used-oil tank 36 and inlet port 74 of metering pump 46. Conduit 80 is connected between outlet port 76 of metering pump 46 and fuel tank 44. A one-way check valve 82 is provided in conduit 78, permitting flow from discharge port 42 to inlet 74, and blocking reverse flow. Metering pump 46 has a drive port 84. Conduit 86 is connected between air tank 20 and drive port 84. Shut-off valve 68 is provided in conduit 86. Upon opening of valve 68, pressurized air is supplied from air tank 20 to pump 46 such that the latter expels used oil from inlet 74 through outlet 76 and conduit 80 to fuel tank 44.

Fresh-oil tank 48 supplies fresh oil to filter 12. Metering pump 56 has an inlet port 92, an outlet port 94, and a drive port 96. Conduit 98 is connected between fresh-oil tank 48 and inlet port 92. A one-way check valve 100 is provided in conduit 98, permitting flow from fresh-oil tank 48 to inlet port 92, and blocking reverse flow. Conduit 102 is connected between outlet port 94 and filter outlet 22 at location 54. Conduit 104 is connected between compressed air source 20 and drive port 96. Shut-off valve 106 is provided in conduit 104. When valve 106 is open, compressed air is supplied from air tank 20 to drive port 96, and pump 56 supplies fresh oil from inlet port 92 through outlet port 94 and conduit 102 to filter 12.

Figure 3:
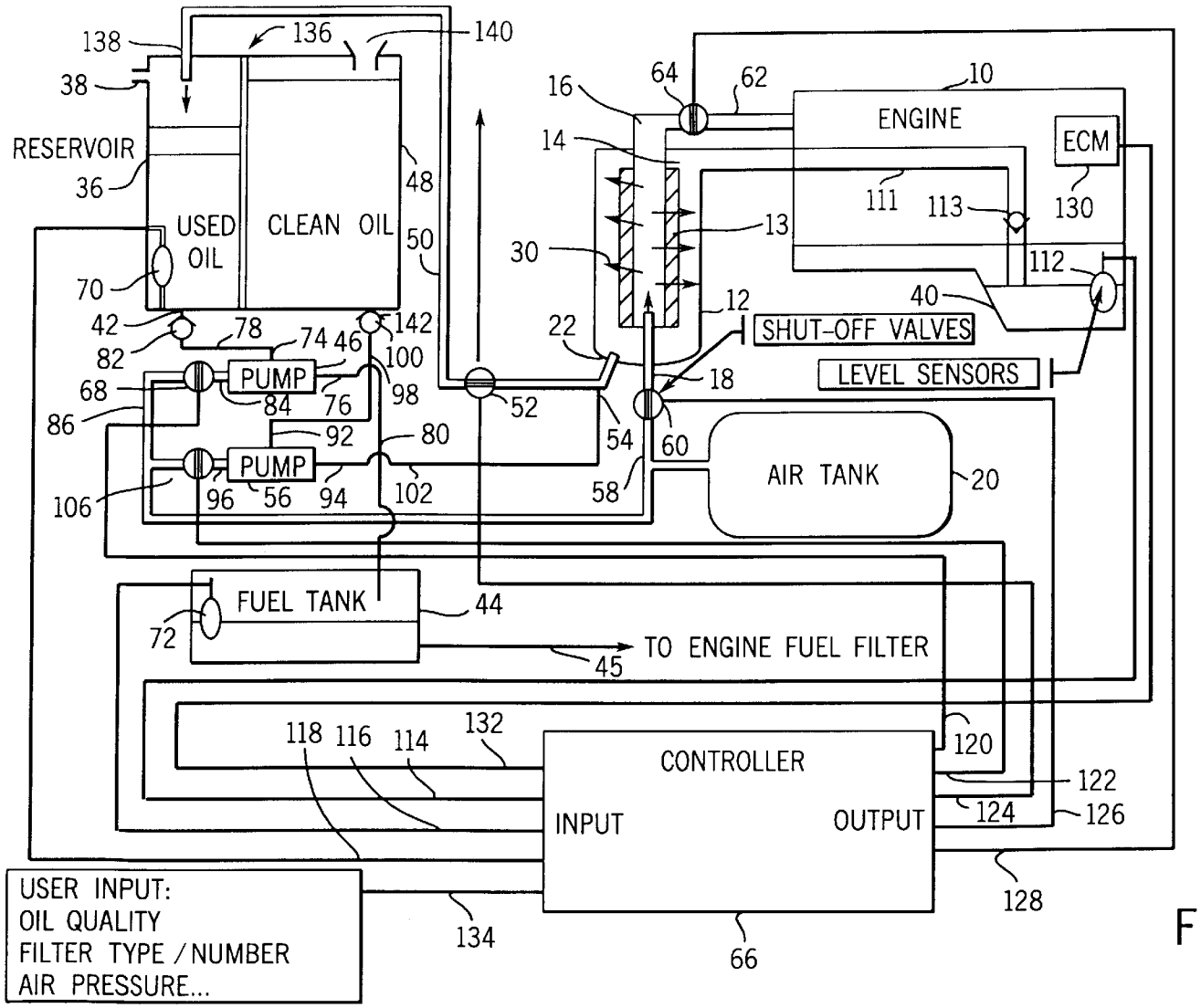
FIG. 3 is like FIG. 1 and shows another operational mode.
Figure 4:
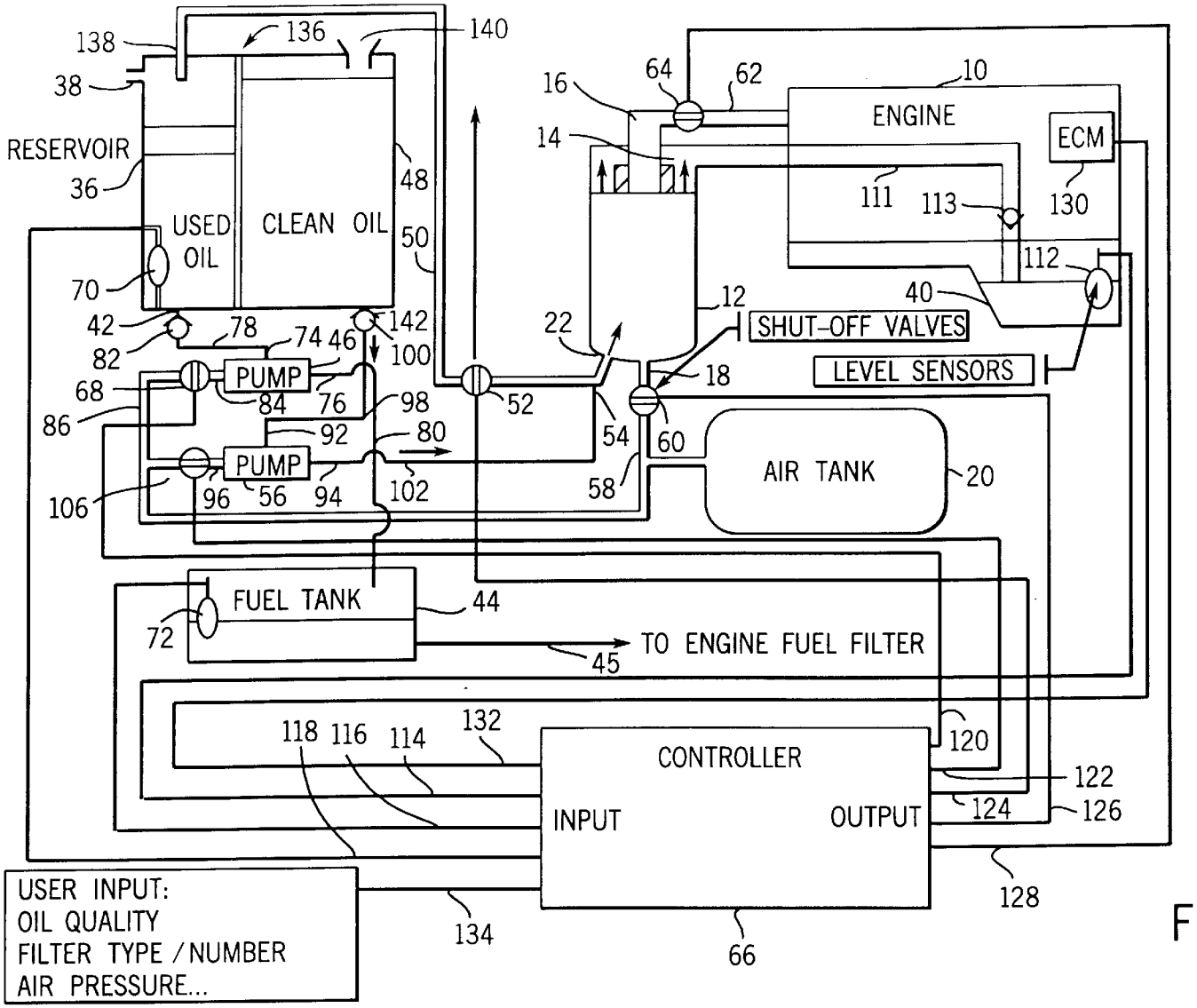
FIG. 4 is like FIG. 1 and shows another operational mode.

Controller 66 has the noted backflush cycle state, FIG. 3, opening shut-off valves 60, 52, and closing shut-off valves 64, 68, 106. Controller 66 has a filter refill or replenishment or replacement cycle, FIG. 4, closing shut-off valves 60, 52, 68, and opening shut-off valve 106. An oil level sensor 112 is provided in oil sump 40 of the engine. Controller 66 is responsive to oil level sensor 112 for changing between the noted states, to enable oil replenishment. Oil sump 40 is connected to filter inlet 14 by conduit 111. A one-way check valve 113 is provided in conduit 111, permitting oil flow from oil sump 40 to filter inlet 14, and blocking reverse flow. The clean fresh oil from tank 48 supplied through pump 56 to filter port 22 thus flows radially inwardly through filter media element 13 and then through filter outlet 16 to the engine.

Figure 5:
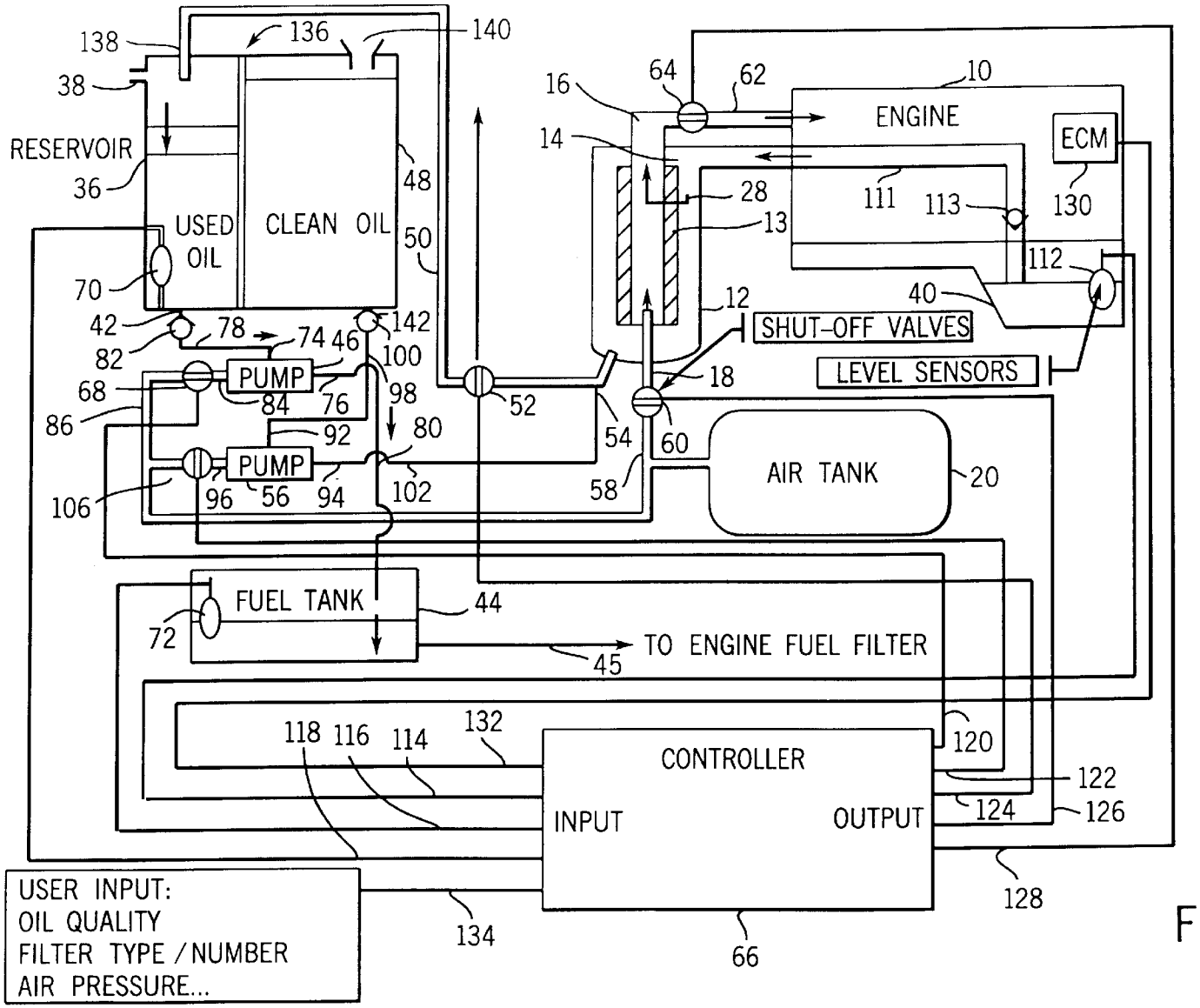
FIG. 5 is like FIG. 1 and shows another operational mode.

Shut-off valve 64 controls the supply of oil from filter outlet 16 to engine 10. Shut-off valve 64 is responsive to controller 66. In the operational state in FIG. 2, valve 64 is open. In the operational state in FIG. 3, valve 64 is closed. In the operational state in FIG. 4, valve 64 may be open or closed, the latter limiting the amount of oil replacement to the capacity of filter 12. In the discharge operational state in FIG. 5, with used oil metered into fuel tank 44, valve 64 is open upon engine re-start.

Controller 66 has inputs 114, 116, 118 from all three level sensors 112, 72, 70, respectively, and has outputs 120, 122, 124, 126, 128 to all five shut-off valves 68, 106, 52, 60, 64, respectively. Engine 10 has an electronic control module 130, and controller 66 has an input 132 from such electronic control module, for data input for determining frequency of the above noted cycles, including backflush, FIG. 3, replenishment, FIG. 4, and used oil metering into the fuel tank for combustion, FIG. 5, according to user or other dictated parameters such as mileage, engine running time, or more accurately duty cycle, e.g. total engine revolutions, EPA (Environmental Protection Agency) emission limits, fuel tank level and/or fuel flow rate, and/or in combination with other factors such as engine load, environment, temperature, elevation, etc., and in combination with various user inputs 134, such as oil quality desired, filter type, air pressure, etc.

In preferred form, a dual compartment reservoir 136 is provided, including a first compartment 36 receiving and storing used oil from filter 12, and a second larger compartment 48 storing and supplying fresh oil to filter 12. Reservoir 136 has inlets 138 and 140 to compartments 36 and 48, respectively. Reservoir 136 has outlets 42 and 142 from compartments 36 and 48, respectively. Inlet 138 of reservoir 136 and outlet 142 of reservoir 136 are connected to filter 12. Inlet 138 and outlet 142 each communicate with dirty side 26 of filter media element 13. Inlet 138 and outlet 142 are each connected to outlet 22 of filter 12. Outlet 22 of filter 12 has a first branch conduit 144 supplying used oil through valve 52 to inlet 138 of reservoir 136, and a second branch outlet 146 receiving fresh lubricant from outlet 142 of reservoir 136. Valve 106 is closed when valve 52 is open. Valve 52 is closed when valve 106 is open.

The disclosed combination provides an in situ oil filter purge and oil replacement system for an internal combustion engine 10 having a fuel tank 44 and an oil sump 40. The purge system, FIG. 3, backflushes filter 12 and supplies backflushed used oil from filter 12 to used-oil tank 36 separate from oil sump 40. The replacement system, FIG. 4, supplies fresh oil from a fresh-oil tank 48 to filter 12. The purge system and the replacement system are both connected to outlet 22 of filter 12. The noted shut-off valves and/or metering pumps provide flow control devices in the systems.

In the present system, a method is provided for cleaning a filter in a lubrication system and replenishing the lubricant, without removing the filter. The method involves: turning off the machine, such as engine 10; closing a flowpath, at valve 64, from outlet 16 of filter 12 to engine 10; opening a flowpath, at valve 52, from outlet 22 of filter 12 to used-oil tank 36; opening a flowpath, at valve 60, from the source of cleaning fluid at air tank 20 to inlet 18 of filter 12, and purging filter 12 by backflushing same with cleaning fluid such as air; upon completion of the blackflushing, closing the flowpath, at valve 60, from air tank 20 to inlet 18 of filter 12, and closing the flowpath, at valve 52, from outlet 22 of filter 12 to used-oil tank 36; opening a flowpath, at valve 106 and metering pump 56, from fresh-oil tank 48 to filter 12 and replenishing filter 12 with fresh oil. After completion of the replenishing, FIG. 4, the flowpath from fresh-oil tank 48 to filter 12 is closed, and the flowpath from outlet 16 of filter 12 to engine 10 is opened, and the flowpath from used-oil tank 36 to fuel tank 44 is opened, FIG. 5, and the engine is re-started. The flowpath between used-oil tank 36 and fuel tank 44 is normally closed. However, in response to a given combination of conditions of fluid levels in both used-oil tank 36 and fuel tank 44, such flowpath is opened. There is no need to open such flowpath if there is no used oil to be discharged. Furthermore, such flowpath is not opened unless there is a sufficient amount of fuel in tank 44 to dilute the metered amount of used oil to an ecologically acceptable level and for combustion by engine 10. The flowpath from fresh-oil tank 48 to filter 12 is opened in response to a given low level condition of oil in sump 40, to provide make-up oil to replace oil consumed during engine operation. The flowpath from fresh-oil tank 48 to filter 12 is also opened to refill the filter after backwashing.

Figure 6:
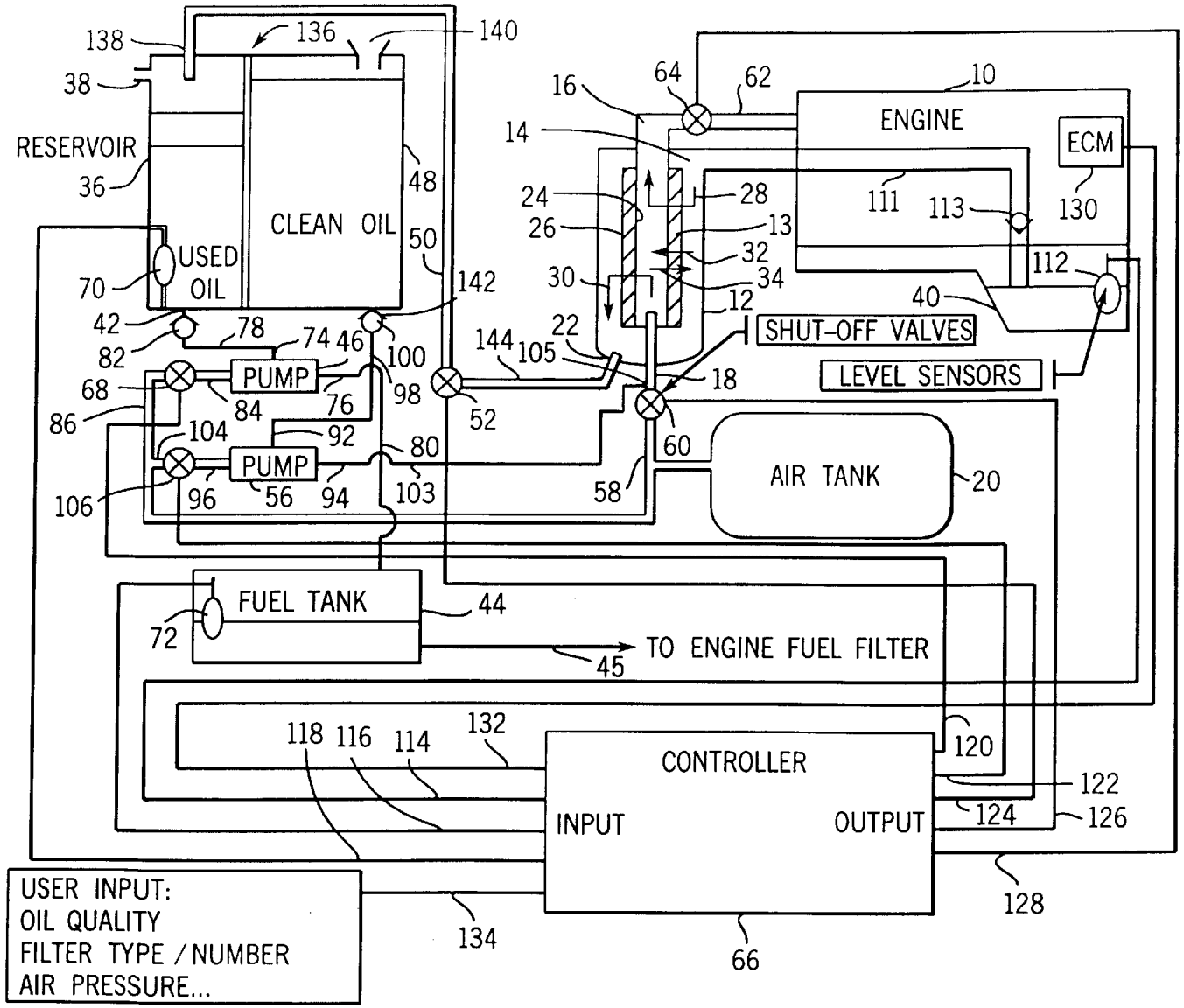
FIG. 6 is like FIG. 1 and shows an alternate embodiment.

In FIG. 6, fresh-lubricant tank 48 supplies fresh lubricant through conduit 98, pump 56, and conduit 103 to the clean side 24 of filter media element 13. The fresh lubricant is supplied to filter inlet 18 through the inlet conduit at a location 105 between filter inlet 18 and shut-off valve 60.

Soft contaminants, such as sludge, are difficult to remove from cleanable oil filters. The present invention enables in combination cleaning fluids that partly break down and then flush the sludge out of the filter media element. Fluids that contain relatively high concentrations of dispersants and detergents, such as new engine oil, can be combined with air during the backflushing process to soften and remove the soft, tacky contaminants. The sludge, new oil, and air are all drained from the filter through drain port 22. Sludge is a problem in applications of severe duty and in engines that idle for extended periods of time. Sludge forms as dispersants in the oil additive package break down, allowing soot to agglomerate. The filter becomes coated with sludge and plugs in a short period of time. It is preferred that in the cleaning backflushing process, the air be supplemented with dispersants and/or detergents. By introducing a cleaning solvent before or during the air backflush process, the sludge can be partly dissolved and then more easily flushed from the filter media element.

In one operational mode of FIG. 6, a cleaning fluid namely fresh oil through conduit 103, is combined with the air from source 20 and introduced through inlet 18. The foaming mixture of air and new oil passes from the clean side 24 of the filter media element 13 through the filter media element as shown at arrow 30 and then out through outlet 22. It is preferred that enough cleaning fluid be used to ensure that the sludge breaks down to a point that it can be removed from the filter media element and flushed out the drain outlet 22. The engine oil sump 40 can also be filled with clean oil through the filter inlet 18. By leaving filter outlet 22 open during such engine oil sump filling operation, a small fraction of clean oil will flow back through the filter media element as shown at arrow 30 and out the drain outlet 22. This helps to remove any remaining sludge.

In a further embodiment in the self cleaning oil filter and oil replenishment system shown in FIG. 6, clean new oil is added to filter 12 at inlet 18 after backwashing and cleaning the filter with air. The new oil refills filter 12 and simultaneously backwashes the filter with new oil. The dispersants in the new oil help remove sludge from the filter. During refilling operations, oil drain valve 52 may either be opened temporarily, to remove some of the new oil with contaminant backwashed off of filter media element 13, or left closed, so as not to waste new oil. In the latter case, the additives in the oil assist in redispersal of the sludge so that it does not replug the filter.

It is recognized that various equivalents, alternatives and modifications are possible within the scope of the appended claims.

What is claimed is:

1. A lubrication system comprising a circulation system circulating lubricant to a machine, a filter in said circulation system and including a filter media element filtering said lubricant, said filter having a first inlet receiving lubricant from said machine, said filter having a first outlet returning lubricant to said machine, said filter having a second inlet receiving a cleaning fluid from a source of cleaning fluid, said filter having a second outlet exhausting said cleaning fluid and used lubricant, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a used-lubricant tank for storing used lubricant therein, a first conduit connected between said source of cleaning fluid and said second inlet, a second conduit connected between said second outlet and said used-lubricant tank, a first shut-off valve in said first conduit, a second shut-off valve in said second conduit, a third conduit connected between said first outlet and said machine, and a third shut-off valve in said third conduit.

2. The invention according to claim 1 comprising a controller having a first state closing said first and second shut-off valves and opening said third shut-off valve, and a second state closing said third shut-off valve and opening said first and second shut-off valves.

3. A lubrication system comprising a circulation system circulating lubricant to a machine, a filter in said circulation system and including a filter media element filtering said lubricant, said filter having a first inlet receiving lubricant from said machine, said filter having a first outlet returning lubricant to said machine, said filter having a second inlet receiving a cleaning fluid from a source of cleaning fluid, said filter having a second outlet exhausting said cleaning fluid and used lubricant, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a used-lubricant tank for storing used lubricant therein, a first conduit connected between said source of cleaning fluid and said second inlet, a second conduit connected between said second outlet and said used-lubricant tank, a first shut-off valve in said first conduit, a second shut-off valve in said second conduit, wherein said machine is an internal combustion engine having a fuel system, and said used-lubricant tank has a discharge port discharging used lubricant to said fuel system, and wherein said fuel system has a fuel tank, and comprising a third valve controlling the supply of used lubricant from said discharge port, a first level sensor in said used-lubricant tank, a second level sensor in said fuel tank, and a controller responsive to both said first and second level sensors for actuating said third valve.

4. A lubrication system comprising a circulation system circulating lubricant to a machine, a filter in said circulation system and including a filter media element filtering said lubricant said filter having a first inlet receiving lubricant from said machine, said filter having a first outlet returning lubricant to said machine, said filter having a second inlet receiving a cleaning fluid from a source of cleaning fluid, said filter having a second outlet exhausting said cleaning fluid and used lubricant, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a used-lubricant tank for storing used lubricant therein, a first conduit connected between said source of cleaning fluid and said second inlet, a second conduit connected between said second outlet and said used-lubricant tank, a first shut-off valve in said first conduit, a second shut-off valve in said second conduit wherein said machine is an internal combustion engine having a fuel system, and said used-lubricant tank has a discharge port discharging used lubricant to said fuel system, and comprising a metering pump having an inlet port and an outlet port, a third conduit connected between said discharge port of said used-lubricant tank and said inlet port of said metering pump, and a fourth conduit connected between said outlet port of said metering pump and said fuel system.

5. The invention according to claim 4 comprising a one-way check valve in said third conduit.

6. The invention according to claim 4 wherein said cleaning fluid is air, said source of cleaning fluid is a source of compressed air, said metering pump is an air-driven metering pump having said inlet port, said outlet port, and a drive port, and comprising a fifth conduit connected between said source of compressed air and said drive port.

7. The invention according to claim 6 comprising a third shut-off valve in said fifth conduit.

8. A lubrication system comprising a circulation system circulating lubricant to a machine, a filter in said circulation system and including a filter media element filtering said lubricant, said filter having a first inlet receiving lubricant from said machine, said filter having a first outlet returning lubricant to said machine, said filter having a second inlet receiving a cleaning fluid from a source of cleaning fluid, said filter having a second outlet exhausting said cleaning fluid and used lubricant, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a fresh-lubricant tank supplying fresh lubricant to said filter, a first conduit connected between said source of cleaning fluid and said second inlet, a second conduit connected to said second outlet, a first shut-off valve in said first conduit, a second shut-off valve in said second conduit, a third conduit supplying fresh lubricant from said fresh-lubricant tank to said first conduit at a location between said second inlet and said first shut-off valve.

9. The invention according to claim 8 wherein said machine comprises an internal combustion engine having an oil sump, and comprising an oil level sensor in said oil sump, and wherein said controller is responsive to said oil level sensor for changing between said states.

10. A lubrication system comprising a circulation system circulating lubricant to a machine, a filter in said circulation system and including a filter media element filtering said lubricant, said filter having a first inlet receiving lubricant from said machine, said filter having a first outlet returning lubricant to said machine, said filter having a second inlet receiving a cleaning fluid from a source of cleaning fluid, said filter having a second outlet exhausting said cleaning fluid and used lubricant, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a fresh-lubricant tank supplying fresh lubricant to said filter, a first conduit connected between said source of cleaning fluid and said second inlet, a second conduit connected to said second outlet, a first shut-off valve in said first conduit, a second shut-off valve in said second conduit, a metering pump having an inlet port and an outlet port, a third conduit connected between said outlet port and said filter, and a fourth conduit connected between said fresh-lubricant tank and said inlet port.

11. The invention according to claim 10 comprising a one-way check valve in said fourth conduit.

12. The invention according to claim 11 wherein said cleaning fluid is air, said source of cleaning fluid is a source of compressed air, said metering pump is an air-driven metering pump having said inlet port, said outlet port, and a drive port, and comprising a fifth conduit connected between said source of compressed air and said drive port.

13. The invention according to claim 12 comprising a third shut-off valve in said fifth conduit.

14. A lubrication system comprising a circulation system circulating lubricant to a machine, a filter in said circulation system and including a filter media element filtering said lubricant, said filter having a first inlet receiving lubricant from said machine, said filter having a first outlet returning lubricant to said machine, said filter having a second inlet receiving a cleaning fluid from a source of cleaning fluid, said filter having a second outlet exhausting said cleaning fluid and used lubricant, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a used-lubricant tank receiving and storing used lubricant from said filter, and a fresh-lubricant tank supplying fresh lubricant to said filter, a first valve controlling the supply of cleaning fluid from said source of cleaning fluid to said second inlet, a second valve controlling the supply of used lubricant from said filter to said used-lubricant tank, a third valve controlling the supply of fresh lubricant from said fresh-lubricant tank to said filter, a controller having a first state opening said first and second valves and closing said third valve, and a second state opening said third valve and closing said first and second valves.

15. The invention according to claim 14 comprising a fourth valve controlling the supply of lubricant from said first outlet to said machine and responsive to said controller, and wherein said controller in said first state closes said fourth valve, and said controller in said second state opens said fourth valve.

16. The invention according to claim 14 wherein said machine comprises an internal combustion engine having a fuel system, said used-lubricant tank has a discharge port discharging used lubricant to said fuel system.

17. The invention according to claim 16 comprising a fourth valve controlling the supply of used lubricant from said discharge port to said fuel system.

18. The invention according to claim 16 comprising a first metering pump having an inlet from said discharge port and an outlet to said fuel system, and a second metering pump having an inlet from said fresh-lubricant tank and an outlet to said filter.

19. The invention according to claim 18 wherein said cleaning fluid is air, said source of cleaning fluid is a source of compressed air, said second inlet of said filter is connected by a first conduit to said source of compressed air, said first valve is in said first conduit, said first metering pump is an air-driven metering pump having said inlet from said discharge port of said used-lubricant tank, said outlet to said fuel system, and a drive port connected by a second conduit to said source of compressed air, and comprising a fourth valve in said second conduit, and wherein said second metering pump is an air-driven metering pump having said inlet from said fresh-lubricant tank, said outlet to said filter, and a drive port connected by a third conduit to said source of compressed air, said third valve is in said third conduit.

20. The invention according to claim 19 comprising in combination a fifth valve controlling the supply of lubricant from said first outlet of said filter to said engine.

21. The invention according to claim 20 wherein said fuel system has a fuel tank, and comprising a controller having a first state opening said first and second valves and closing said third and fifth valves, and a second state opening said third valve and closing said first and second valves, and comprising a first level sensor in said used-lubricant tank, and a second level sensor in said fuel tank, and wherein said fourth valve is actuated by said controller responsive to said first and second level sensors.

22. The invention according to claim 21 wherein said engine has an oil sump, and comprising a third level sensor in said oil sump, and wherein said third valve is actuated by said controller responsive to said third level sensor.

23. A lubrication system comprising a circulation system circulating lubricating oil to an internal combustion engine, said engine having a fuel system, a filter in said circulation system and including a filter media element filtering said oil, said filter having a first inlet receiving oil from said engine, said filter having a first outlet returning oil to said engine, said filter having a second inlet receiving a cleaning fluid from a source of cleaning fluid, said filter having a second outlet exhausting said cleaning fluid and used oil, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a used-oil tank receiving and storing used oil from said filter and supplying said used oil to said fuel system, a fresh-oil tank supplying fresh oil to said filter, a combination comprising five valves comprising a first valve controlling the supply of cleaning fluid from said source of cleaning fluid to said second inlet, a second valve controlling the supply of oil from said first outlet to said engine, a third valve controlling the supply of used oil from said filter to said used-oil tank, a fourth valve controlling the supply of used oil from said used-oil tank to said fuel system, a fifth valve controlling the supply of fresh oil from said fresh-oil tank to said filter.

24. The invention according to claim 23 comprising a central controller having outputs to all five said valves.

25. The invention according to claim 24 wherein said engine has an oil sump, said fuel system has a fuel tank, and comprising a combination comprising three level sensors comprising a first level sensor in said used-oil tank, a second level sensor in said fuel tank, and a third level sensor in said oil sump, and wherein said controller has inputs from all three said level sensors.

26. The invention according to claim 25 wherein said engine has an electronic control module, and wherein said central controller has an input from said electronic control module.

27. The invention according to claim 26 wherein said cleaning fluid is air, and said source of cleaning fluid is a source of compressed air, and wherein said central controller has a plurality of user inputs, including oil quality, filter type, and air pressure.

28. The invention according to claim 23 wherein said system has a plurality of operational conditions, including:

a) normal operation with said engine running, said second valve open, and said first, third, fourth, fifth valves closed;

b) a backflush operation with said engine off, said first, third valves open, and said second, fourth, fifth valves closed;

c) a refill operation with said engine off, said second, fifth valves open, and said first, third, fourth valves closed; and d) a discharge operation with said engine running, said second, fourth valves open, and said first, third, fifth valves closed.

29. A lubrication system comprising a circulation system circulating lubricating oil to an internal combustion engine, said engine having a fuel system, a filter in said circulation system and including a filter media element filtering said oil, said filter having a first inlet receiving oil from said engine, said filter having a first outlet returning oil to said engine, said filter having a second inlet receiving a cleaning fluid from a source of cleaning fluid, said filter having a second outlet exhausting said cleaning fluid and used oil, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a dual compartment reservoir comprising a first compartment receiving and storing used oil and backflushed contaminant from said filter, and a second compartment storing fresh oil and supplying same to said filter, wherein said reservoir has first and second inlets to said first and second compartments, respectively, and first and second outlets from said first and second compartments, respectively, said first inlet of said reservoir and said second outlet of said reservoir being connected to said filter, said first inlet of said reservoir and said second outlet of said reservoir each communicate with said dirty side of said filter media element, said first inlet of said reservoir and said second outlet of said reservoir are each connected to said second outlet of said filter, said second outlet of said filter has a first branch conduit supplying used oil through a first valve to said first inlet of said reservoir, and a second branch conduit receiving fresh oil from said second outlet of said reservoir, and comprising a second valve controlling the supply of fresh oil from said second outlet of said reservoir through said second branch conduit, said second valve being closed when said first valve is open, said first valve being closed when said second valve is open, and wherein said first outlet of said reservoir supplies used oil to said fuel system, and comprising a first metering pump controlling the supply of said used oil from said first outlet of said reservoir to said fuel system, and wherein said second valve comprises a second metering pump controlling the supply of fresh oil from said second outlet of said reservoir through said second branch circuit.

30. The invention according to claim 29 comprising first and second one-way check valves between said first and second outlets of said reservoir and said first and second metering pumps, respectively.

31. A lubrication system comprising a circulation system circulating lubricating oil to an internal combustion engine, said engine having a fuel system, a filter in said circulation system and including a filter media element filtering said oil, said filter having a first inlet receiving oil from said engine, said filter having a first outlet returning oil to said engine, said filter having a second inlet receiving a cleaning fluid from a source of cleaning fluid, said filter having a second outlet exhausting said cleaning fluid and used oil, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, a dual compartment reservoir comprising a first compartment receiving and storing used oil and backflushed contaminant from said filter, and a second compartment storing fresh oil and supplying same to said filter, wherein said reservoir has first and second inlets to said first and second compartments, respectively, and first and second outlets from said first and second compartments, respectively, said first inlet of said reservoir and said second outlet of said reservoir being connected to said filter, said first inlet of said reservoir communicates with said dirty side of said filter media element, and said second outlet of said reservoir communicates with said clean side of said filter media element, said first inlet of said reservoir is connected to said second outlet of said filter, and said second outlet of said reservoir is connected to said second inlet of said filter, second outlet of said filter has a conduit supplying used oil through a first valve to said first inlet of said reservoir, and said second inlet of said filter has a conduit receiving fresh oil through a second valve from said second outlet of said reservoir, said second valve being closed when said first valve is open, said first valve being closed when said second valve is open, and wherein said first outlet of said reservoir supplies used oil to said fuel system, and comprising a first metering pump controlling the supply of said used oil from said first outlet of said reservoir to said fuel system, and wherein said second valve comprises a second metering pump controlling the supply of fresh oil from said second outlet of said reservoir to said second inlet of said filter.

32. A combination in situ oil filter purge and oil replacement system for an internal combustion engine having a fuel system and an oil sump, comprising a used-oil tank, a conduit connected between said filter and said used-oil tank and bypassing said oil sump, and a purge system backflushing said filter and supplying used oil and backflushed contaminant from said filter through said conduit to said used-oil tank without passing through said oil sump, a replacement system supplying fresh oil from a fresh-oil tank to said filter, and comprising in combination:

a first flow control device in said purge system, and having an open condition supplying cleaning fluid to said filter for backflushing same, and having a closed condition blocking the flow of said cleaning fluid to said filter;

a second flow control device in said purge system, and having an open condition supplying backflushed cleaning fluid and used oil to said used-oil tank, and having a closed condition blocking the flow of said backflushed cleaning fluid and used oil to said used-oil tank;

a third flow control device in said replacement system, and having an open condition supplying fresh oil from said fresh-oil tank to said filter, and having a closed condition blocking the flow of said fresh oil from said fresh-oil tank to said filter.

33. The invention according to claim 32 comprising a controller having outputs to said first, second and third flow control devices, and controlling said flow control devices such that:

a) when said first and second flow control devices are in said open condition, said third flow control device is in said closed condition; and b) when said third flow control device is in said open condition, said first and second flow control devices are in said closed condition.

34. The invention according to claim 33 comprising a fourth flow control device having an open condition supplying used oil from said used-oil tank to said fuel system, and having a closed condition blocking the flow of said used oil from said used-oil tank to said fuel system, and wherein said controller has an output to said fourth flow control device.

35. The invention according to claim 34 wherein said fuel system has a fuel tank, and comprising a first fluid level sensor in said used-oil tank, a second fluid level sensor in said fuel tank, and wherein said controller has inputs from said first and second fluid level sensors and actuates said fourth flow control device in response to a given combination of fluid levels sensed by both said first and second fluid level sensors.

36. The invention according to claim 35 comprising a third fluid level sensor in said oil sump, and wherein said controller has an input from said third fluid level sensor and actuates said third flow control device to said open condition in response to a given low level in said oil sump, to provide make-up oil to replace oil consumed during engine operation.

37. The invention according to claim 34 comprising a fifth flow control device having an open condition supplying oil from said filter to said engine, and having a closed condition blocking the flow of said oil from said filter to said engine, and wherein said controller has an output to said fifth flow control device and controls said fifth flow control device such that when said first and second flow control devices are in said open condition said fifth flow control device is in said closed condition.

38. A combination in situ oil filter purge and oil replacement system for an internal combustion engine having a fuel system and an oil sump, comprising a used-oil tank, a conduit connected between said filter and said used-oil tank and bypassing said oil sump and a purge system backflushing said filter and supplying used oil and backflushed contaminant from said filter through said conduit to said used-oil tank without passing through said oil sump a replacement system supplying fresh oil from a fresh-oil tank to said filter, and wherein said filter comprises a filter media element filtering said oil, said filter has a first inlet receiving oil from said engine, said filter has a first outlet returning oil to said engine, said filter has a second inlet receiving a cleaning fluid from a source of cleaning fluid, said filter has a second outlet exhausting said cleaning fluid and used oil, said filter media element has a clean side communicating with said first outlet and said second inlet, said filter media element has a dirty side communicating with said first inlet and said second outlet, and said replacement system supplies said fresh oil to said dirty side of said filter media element.

39. The invention according to claim 38 wherein said purge system and said replacement system are both connected to said second outlet of said filter.

40. A combination in situ oil filter purge and oil replacement system for an internal combustion engine having a fuel system and an oil sump, comprising a used-oil tank, a conduit connected between said filter and said used-oil tank and bypassing said oil sump and a purge system backflushing said filter and supplying used oil and backflushed contaminant from said filter through said conduit to said used-oil tank without passing through said oil sump a replacement system supplying fresh oil from a fresh-oil tank to said filter, and wherein said filter comprises a filter media element filtering said oil, said filter has a first inlet receiving oil from said engine, said filter has a first outlet returning oil to said engine, said filter has a second inlet receiving a cleaning fluid from a source of cleaning fluid, said filter has a second outlet exhausting said cleaning fluid and used oil, said filter media element has a clean side communicating with said first outlet and said second inlet, said filter media element has a dirty side communicating with said first inlet and said second outlet, and said replacement system supplies fresh oil to said clean side of said filter media element.

41. The invention according to claim 40 wherein said purge system is connected to said second outlet of said filter, and said replacement system is connected to said second inlet of said filter.

42. A combination in situ oil filter purge and oil replacement system for an internal combustion engine having a fuel system and an oil sump, comprising a fresh-oil tank, a first conduit connected between said filter and said fuel system, a second conduit connected between said fresh-oil tank and said filter and bypassing said oil sump, and a purge system backflushing said filter and supplying used oil and backflushed contaminant from said filter through said first conduit to said fuel system, and a replacement system supplying fresh oil from said fresh-oil tank through said second conduit to said filter without passing through said oil sump.

43. The invention according to claim 42 wherein said fuel system comprises a fuel tank, and wherein said used oil and backflushed contaminant are supplied from said filter to said fuel tank.

44. The invention according to claim 42 wherein said used oil and backflushed contaminant are supplied from said oil filter through a used-oil tank to said fuel system.

45. A method for cleaning a filter in a lubrication system and replenishing lubricant, without removing said filter, said lubrication system comprising a circulation system circulating lubricant to a machine, a filter in said circulation system and including a filter media element filtering said lubricant, said filter having a first inlet receiving lubricant from said machine, said filter having a first outlet returning lubricant to said machine, said filter having a second inlet receiving a cleaning fluid from a source of cleaning fluid, said filter having a second outlet exhausting said cleaning fluid and used lubricant, said filter media element having a clean side communicating with said first outlet and said second inlet, said filter media element having a dirty side communicating with said first inlet and said second outlet, said filter having a first flowpath therethrough from said first inlet through said filter media element in one direction to said first outlet, said filter having a second flowpath therethrough from said second inlet through said filter media element in the opposite direction to said second outlet, said first and second flowpaths having common but opposite direction portions through said filter media element, said method comprising:

turning off said machine;

closing a flowpath from said first outlet of said filter to said machine;

opening a flowpath from said second outlet of said filter to a used-lubricant tank;

opening a flowpath from said source of cleaning fluid to said second inlet of said filter;

purging said filter by backflushing same with said cleaning fluid;

closing said flowpath from said source of cleaning fluid to said second inlet of said filter;

closing said flowpath from said second outlet of said filter to said used-lubricant tank;

opening a flowpath from a fresh-lubricant tank to said filter and replenishing said filter with fresh lubricant.

46. The method according to claim 45 comprising, during said replenishing step, supplying said fresh lubricant from said fresh-lubricant tank to said dirty side of said filter media element.

47. The method according to claim 46 comprising, during said replenishing step, supplying said fresh lubricant from said fresh-lubricant tank to said second outlet of said filter.

48. The method according to claim 45 comprising, during said replenishing step, supplying said fresh lubricant from said fresh-lubricant tank to said clean side of said filter media element.

49. The method according to claim 48 comprising, during said replenishing step, supplying said fresh lubricant from said fresh-lubricant tank to said second inlet of said filter.

50. The method according to claim 45 wherein said machine comprises an internal combustion engine having a fuel system, and comprising:

after completion of said replenishing, closing said flowpath from said fresh-lubricant tank to said filter;

opening said flowpath from said first outlet of said filter to said engine;

opening a flowpath from said used-lubricant tank to said fuel system.

51. The method according to claim 50 wherein said fuel system has a fuel tank, and comprising closing said flowpath between said used-lubricant tank and said fuel system, during running of said engine, in response to a given combination of conditions of fluid levels in both said used-lubricant tank and said fuel tank.

52. The method according to claim 51 wherein said engine has a lubricant sump, and comprising:

opening said flowpath from said fresh-lubricant tank to said filter in response to a given condition of lubricant level in said sump, to provide make-up lubricant to replace lubricant consumed during engine operation.

* * * * *